US009966647B1

(12) United States Patent
Swanson et al.

(10) Patent No.: US 9,966,647 B1
(45) Date of Patent: May 8, 2018

(54) OPTICALLY DEFINED ANTENNA

(71) Applicants: Paul David Swanson, Santee, CA (US); Sam Chieh, San Diego, CA (US)

(72) Inventors: Paul David Swanson, Santee, CA (US); Sam Chieh, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 11 days.

(21) Appl. No.: 15/186,812

(22) Filed: Jun. 20, 2016

(51) Int. Cl.
*H01Q 1/06* (2006.01)
*H01Q 3/26* (2006.01)
*H01Q 21/06* (2006.01)

(52) U.S. Cl.
CPC ..... *H01Q 1/06* (2013.01); *H01Q 3/2676* (2013.01); *H01Q 21/061* (2013.01)

(58) Field of Classification Search
CPC ..... H01Q 1/06; H01Q 3/2676; H01Q 21/061
USPC ..... 343/721
See application file for complete search history.

(56) References Cited

U.S. PATENT DOCUMENTS 5,262,796 A * 11/1993 Cachier ..... H01Q 3/2676 343/753
7,561,109 B2 7/2009 Walton et al.
2008/0198074 A1* 8/2008 Walton ..... H01Q 3/01 343/700 MS
2011/0115686 A1* 5/2011 Hauhe ..... H01Q 1/422 343/841

* cited by examiner

*Primary Examiner* — Andrea Lindgren Baltzell
(74) *Attorney, Agent, or Firm* — SSC Pacific Patent Office; Arthur K. Samora; Kyle Eppele

(57) ABSTRACT

A software defined antenna can include a light source and a photoconductive surface. The photoconductive surface can be two-dimensional or three-dimensional. A plurality of electrically isolated pixels can be embedded in the photoconductive surface. The antenna can further include a processor with computer software incorporated to manipulate the light source to selectively illuminate the surface matrix in a predetermined pattern. As the surface matrix becomes illuminated, the illuminated portion of the matrix surface electrically connects the pixels, resulting in the desired radiation pattern. The software can be manipulated to further manipulate the light source to change antenna frequency, gain and bandwidth parameters, as desired by the user. Similarly, the pixels can be selectively illuminated to cause a desired radiation pattern, such as circular, sector scan or raster patterns.

20 Claims, 4 Drawing Sheets

OPTICALLY DEFINED ANTENNA

FEDERALLY SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil, referencing NC 102577.

FIELD OF THE INVENTION

The present invention pertains generally to antennas and methods. More specifically, this invention pertains to antennas that can use computer software to manipulate a light source to project a defined, rastered output light pattern, which can photoconductively connect electrically isolated pixels to define an antenna on a surface. The invention is particularly, but not exclusively, useful as a software defined antenna that can allow for instantaneous arbitrary definition of conductive surfaces, which can further permit the operating frequency, bandwidth and gain of the software defined antenna to be changed at any time.

BACKGROUND OF THE INVENTION

Antennas can be thought of as electric transducers, which can convert electric power into propagating radio waves. Antennas can be categorized into two groups, traveling wave antennas and resonant antennas. Traveling wave antennas utilize a guiding structure as the main method of radiation and are generally characterized by a matched termination. The current can be defined in terms of waves traveling in only one direction. Resonant antennas can be characterized by an open circuit; the main method of radiation for resonant antennas is through standing waves.

Antennas of either type usually have design features such as frequency of operation, bandwidth, and gain, which are directly related to its geometric shape and surface area. Current antenna design methodologies seek to optimize the geometric and volumetric shape/space for operation for a specified frequency, bandwidth, and required gain. This is mainly because in the prior art, the physical structure of the antenna, once defined, cannot be modified to operate at a different frequency, nor at a different bandwidth, nor at a different gain. Nearly all antennas are realized either in a planar form on a printed circuit board (PCB), or in some kind of solid structure such as a waveguide or a fiberglass dish. The antenna structure cannot be re-cast instantaneously if the operator desires a different operating frequency, bandwidth or gain.

In view of the above, it can be an object of the present invention to provide a software defined antenna, which can instantaneously change the antenna operating structure to achieve a design gain, operating frequency or bandwidth. Another object of the present invention can be to provide a software defined antenna that can arbitrarily change the conductive surface of the antenna according to the user's needs. Still another of the present invention can be to provide a software defined antenna that uses a projected or rastered image to photoconductively connect electrically isolated pixels to define an antenna on a conductive surface. Yet another object of the present invention can be to provide a software defined antenna that can accomplish beam steering without the use of mechanical components, and without manipulating changes in phase of the outgoing antenna beam. Still another object of the present invention can be to provide a software defined antenna that can be relatively easy to manufacture, that can be used in a cost-effective manner, and that can be durable.

SUMMARY OF THE INVENTION

A software defined antenna according to several embodiments of the present invention can include a light source and a photoconductive surface. The photoconductive surface can be two-dimensional or three-dimensional. A plurality of electrically isolated pixels can be embedded in the photoconductive surface. The antenna can further include a processor with computer software instructions to manipulate the light source to selectively illuminate the photoconductive surface matrix in a predetermined pattern. As the surface matrix becomes illuminated, the illuminated portion of the photoconductive matrix surface electrically connects the pixels, resulting in the desired radiation pattern. The software can be manipulated to further manipulate the light source to change antenna frequency, gain and bandwidth parameters, as desired by the user. Similarly, the pixels can be selectively illuminated to cause a desired radiation pattern, such as circular, sector scan or raster patterns.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

In brief overview, software defined radios have made great strides in providing generic hardware (radios) that can be configured (via computer software) for multiple bands and radio modulation methods. However, software controllable antennas have lagged behind in this flexibility. Reconfigurable antennas are important as oftentimes a single antenna aperture can be necessary for supporting multiple operating frequencies, signal bandwidths, and gains for a specific link budget. The ability to dynamically change the geometries of the antenna structure can also lead to various possibilities that were not feasible before. For example, the user could dynamically change the shape and position of the antenna to create nulls and position sidelobes in desired pointing angles to mitigate interception of signals. The user could also arbitrarily create and define antenna arrays to boost the EIRP (effective isotropic radiated power) in order to gain greater link margins for LOS (line-of-sight) radio links.

Figure 1:
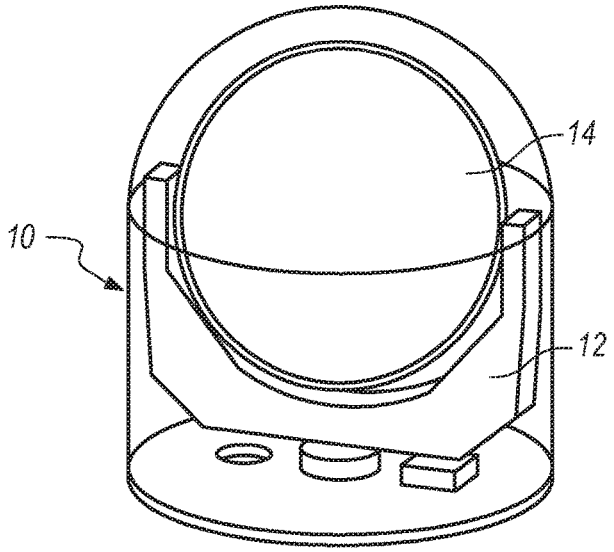
FIG. 1 (Prior Art)
FIG. 1 is a block diagram of a prior art antenna that uses mechanical gimbals to steer an output antenna beam.
Figure 2:
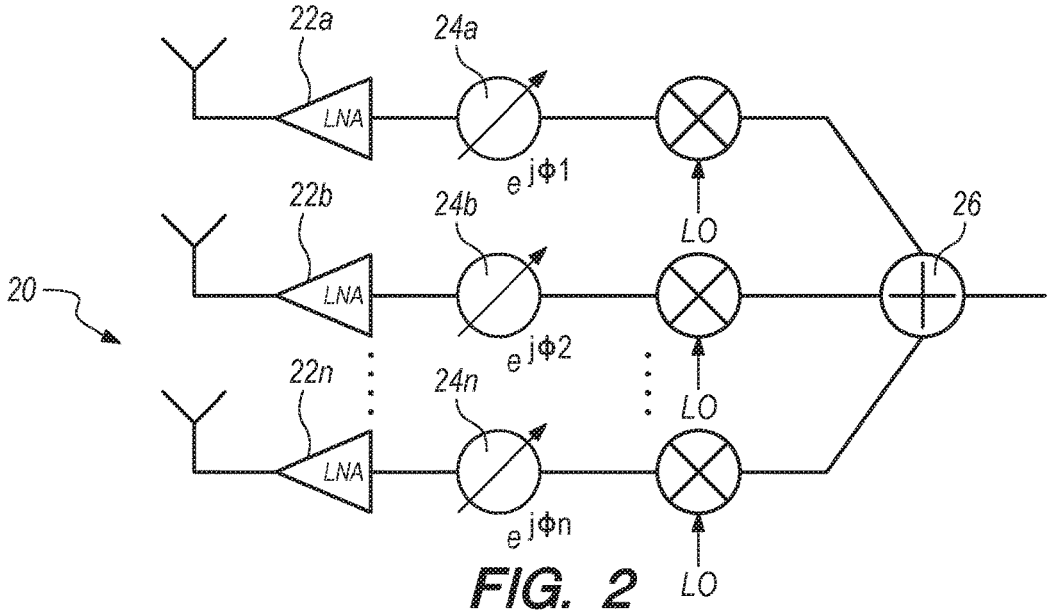
FIG. 2 (Prior Art)
FIG. 2 is a schematic of a prior art antenna, which uses phase differences in a plurality of output antenna element beams, to generate and direct an overall output beam.

Oftentimes, and referring now to FIGS. 1 and 2, the ability to steer the antenna beam direction is critical. As shown by prior art antenna 10 in FIG. 1, this can often be realized by utilizing a mechanical gimbal 12 that can position an antenna dish 14 as shown in FIG. 1, to emit a beam in a fixed direction. The gimbal 12 can allow for rotation of the fixed beam antenna, but is not preferred because it has moving parts which can be subject to mechanical failure. Also, these prior art antennas can be limited by the slew rate of the antenna, which can be further limited by inertia due to the weight of the antenna 10 as gimbal 12 is operated to rotate and/or elevate dish 14.

As depicted by FIG. 2, phased array 20 antennas can also be widely utilized in the prior art for beam steering applications, where the phase/time delay 24 between adjacent antenna elements 22*a*, 22*b* can be adjusted to achieve an overall beam angle 26, as depicted in FIG. 2. However, the need for a phase shifter(s) or time-delay element(s) can be costly and can require very dense and large scale integration.

If three-dimensional control and reconfiguration of the antenna structure geometry and position is possible, but without requiring moving parts or phase shifting of beams, then the antenna beam direction at boresight could be adjusted without the need for either moving parts or complex and costly electronics.

Figure 3:
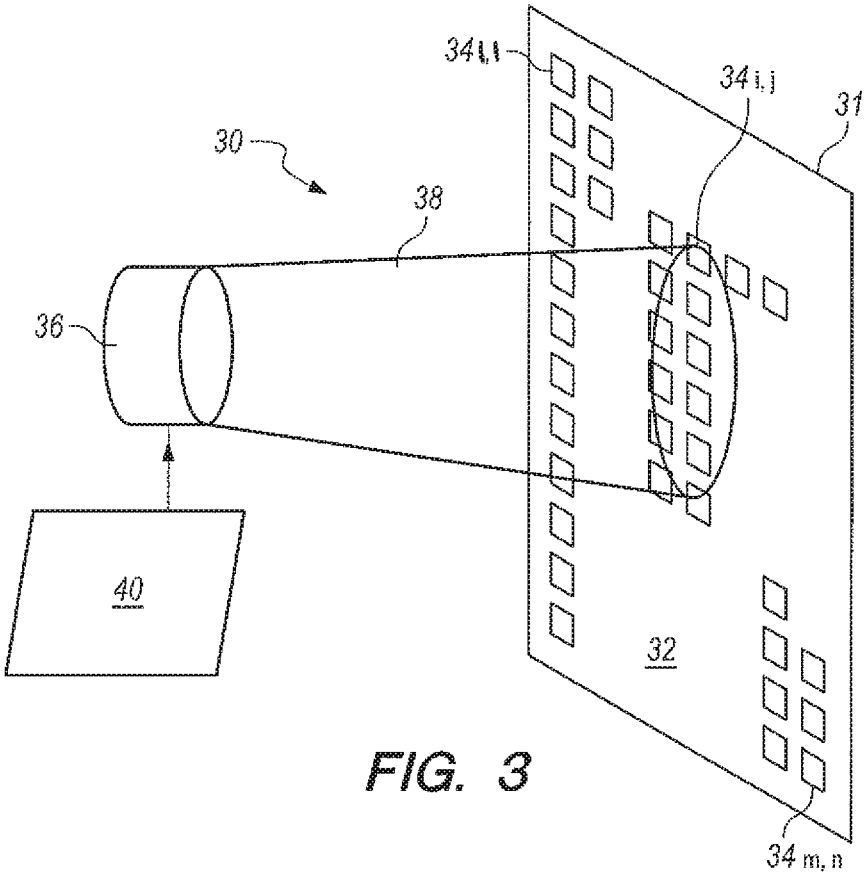
FIG. 3 is a block diagram of an optically defined antenna of the present invention according to several embodiments.

Referring now to FIG. 3, the optically defined antenna of the present invention is shown and is generally designated by reference character 30. As shown, antenna 30 can include a radiating element 31, which can further include a photoconductive surface matrix 32, and a plurality of pixels $\mathbf{34}_{i,j}$, which can be embedded in photoconductive surface matrix 32 in an m×n array, so that they are electrically isolated from each other. The antenna 30 can further include a light source 36, which can selectively illuminate all or portions of photoconductive surface matrix 32 with light beam 38, according to a predetermined pattern. As photoconductive surface matrix 32 is illuminated, the electrically isolated pixels 34 that are embedded in photoconductive surface matrix 32 and that are located with the illumination pattern of beam 38 can become electrically connected, and can further transmit an antenna beam, according to the user's needs.

As shown in FIG. 3, the antenna according to several embodiments can also include a processor 40. Processor 40 can contain computer software. The computer software, when executed, can contain instructions to manipulate light source 36 to cause light beam 38 to manipulate the dish to obtain a certain desired beam pattern. The types of patterns can include circular, conical, custom, bidirectional raster, unidirectional raster, bidirectional sector and unidirectional sector. Other patterns could also be generated, or alternatively beam 38 can simply illuminate all of matrix surface 32 continuously, or in a predetermined on/off pattern. Since the optical pattern can define the beam, and the software in processor 40 can define the optical pattern, the antenna 30 of the present invention could also be considered as an optically defined antenna, or further as a software defined antenna.

The photoconductive surface matrix 32 can be a planar or three-dimensional surface, such as a concave or convex radome, or a parabolic dish shape, or any other shape known in the art for antenna radiating elements. The pixels 34 embedded in photoconductive surface matrix 32 can be arranged in an electrically isolated, interdigitated manner, as described more fully below. The pixels can be of various shapes and patterns including fractal patterns.

Figure 4:
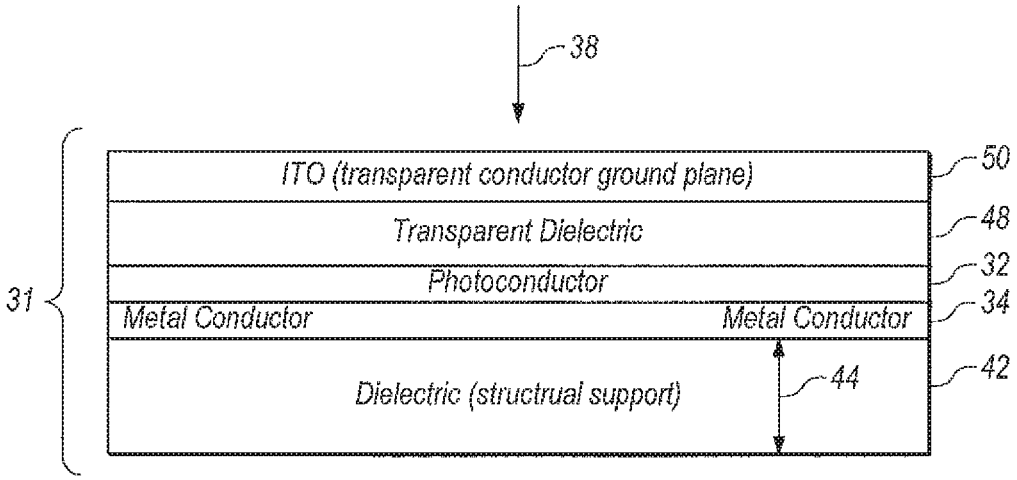
FIG. 4 is a cross-sectional view of the surface matrix and pixel components of the antenna of FIG. 3.

Referring now to FIG. 4, a cross-sectional view of the radiating element 31 of antenna 30 is shown. As shown, radiating element 31 can include a supporting dielectric substrate 42 of thickness 44, which can be transparent to RF (radio frequency) transmissions, with a pattern of conductive, but electrically isolated pixels 34 across its surface. Covering (and filling the gaps between) the pixels 34 can be a photoconducting surface matrix 32, which can be chosen to have a material with a long photo-generated carrier lifetime. Above the photoconducting surface matrix 32 is a transparent dielectric 48, and on the transparent dielectric 48 is a transparent, conductive ground plane 50. One material that could be used for transparent, conductive ground plane 50 can be Indium Tin Oxide (ITO).

The antenna could be constructed of alternate materials. The shape of the dielectric substrate frame could be a non-flat surface, provided the surface can be illuminated by the optical source defining the antenna shape. The photoconductive matrix surface 32 could be positioned under the pixels 34 instead of above them. The ground plane 50 could be on the opposite side of element 31 being illuminated by light beam 38 and can consist of a conventional conducting material (metal). The surface of radiating element 31 could be cylindrical, conical or domed to create three dimensional antennas.

Figure 5:
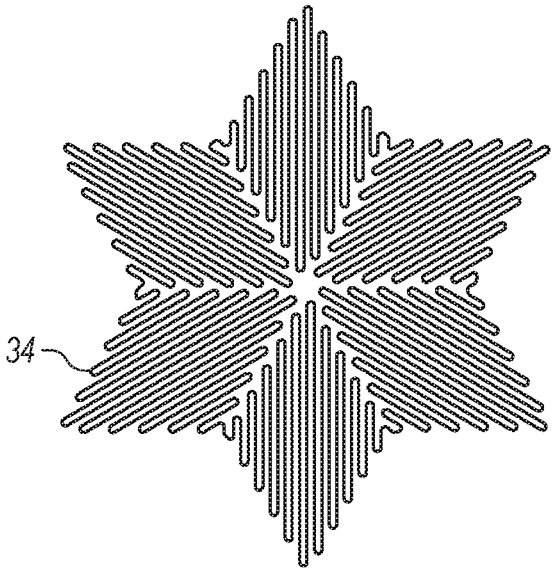
FIG. 5 is a greatly enlarged top plan view of a pixel from the antenna of FIG. 3.
Figure 6:
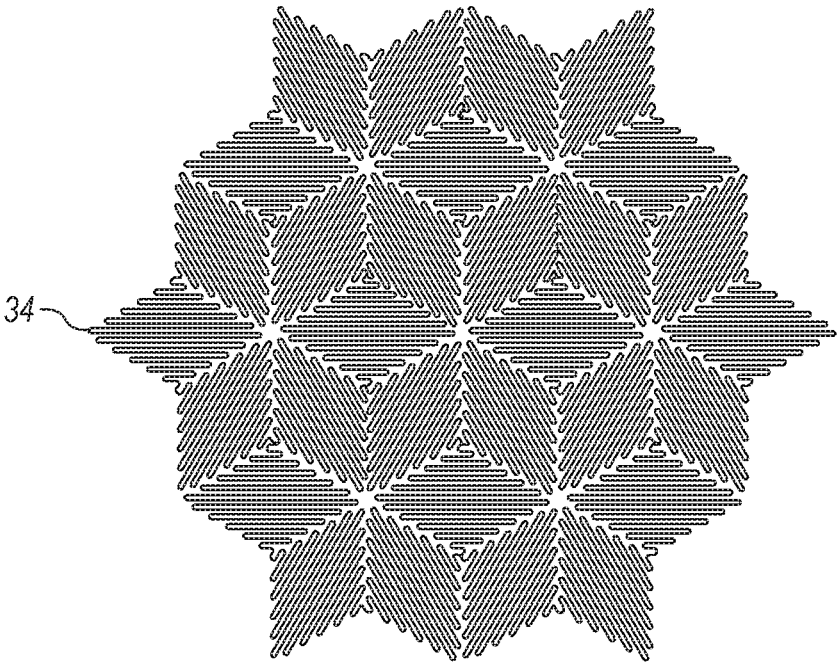
FIG. 6 is top plan view of a plurality of the pixels of FIG. 5.
Figure 7:
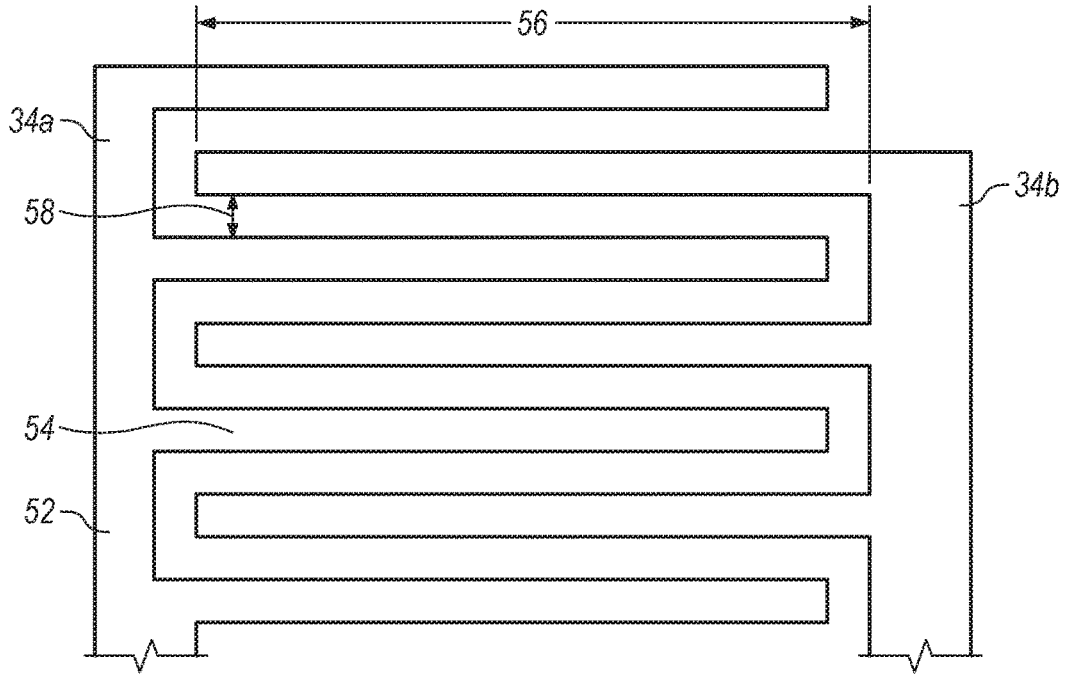
FIG. 7 is a top plan view of a greatly enlarged portion of the pixels of FIG. 5, which shows an alternative top plan geometry for the pixels; and, FIG. 8 is a block diagram, which illustrates steps that can be taken to accomplish the methods of the present invention according to several embodiments.

Referring now to FIGS. 5-7, the structure of the pixels 34 can be shown in greater detail. As shown, the pixels 34 can be designed with a geometry that can cover the plane of surface matrix 32, and also so that adjacent pixels 34 can have a maximum shared edge length with their nearest neighbors. FIG. 5 shows one such pixel design (where pixel 34 is star shaped when viewed in top plan). FIG. 6 shows how the pixel design of FIG. 5 assembles to fill the plane. It should be appreciated, that the pixels could have different geometries. For example, pixels 34 that are square when viewed in top plan could be used.

FIG. 7 shows an alternative square embodiment for pixel 34. More specifically, FIG. 7 illustrates a greatly enlarged portion of a square pixel embodiment. As shown, pixel 34 can have base portion 52 and a plurality of tines 54 that can extend from the base portion 52. The tines 54 of pixels 34 can be sized so that the edge length 56 between each tine 54 can be maximized. Adjacent pixels 34*a*, 34*b* can also be embedded in the surface matrix 32 so adjacent pixels 34 are interdigitated, or arranged so that the tines 54 or a pixel 34 are inserted in the spaces between the tines 54 of an adjacent pixel 34*b*, as shown in FIG. 7. With this configuration, the gap 58 between pixels 34 can be minimized.

It should be appreciated that the geometries of the pixels 34 do not need to be identical, and can be any design which maximizes edge distance and minimizes the gap between adjacent pixels. The size of the pixels needs to be much smaller than the desired operating wavelength in order for the structure to look like a metal plane. Since the pixels that are not illuminated are not electrically connected, current cannot flow, and therefore behaves as a transparent plane. Stated differently, the size of the pixels needs to be much smaller than the operating wavelength so that the surface roughness of the pixels does not become a factor when the pixels become electrically connected, and so that the pixels are not illuminated (i.e. not electrically connected) are transparent to the generated radiation pattern.

When the matrix surface 32 is illuminated, the edges 52 of the pixels 34 that are within this illuminated portion of the matrix surface become electrically connected, because the gap 54 between the pixels can become conductive. In this manner, the pixels 34 that are within beam 38 can define a radiation pattern on the conductive matrix surface. The antenna could be optically illuminated on one side, and transmit and/or receive RF signals on the opposite side, due to the ITO ground plane on the illumination side. The minimum feature size would be partially dictated by the smallest laser/light beam that one could achieve.

The types of antennas that would be possible to realize using this type of fabrication approach are planar in nature but could be conformal. The microstrip type of antennas would be highly applicable. There are many nuances in the fabrication steps that would affect the antenna performance. The first would be the effect of the dielectric structural support.

A second parameter that can be taken into account is the surface roughness of the pixels and the photoconductive surface matrix 32. The surface roughness can affect the loss of the metal and therefore the efficiency of the antenna. The attenuation due to surface roughness can be estimated as (Equation 1):

$$\text{Attenuation} = \text{conductivity} \quad \text{Eq. (1)}$$

$$\text{attenuation}\left[1+\left(\frac{2}{\pi}\right)\times\tan^{-1}\left\{1.4\times\left(\frac{\text{RMS roughness}}{\text{skin depth}}\right)^2\right\}\right]$$

Where conductivity attenuation (due to conductivity of the metal within the pixel) measured in dB per unit length, RMS roughness is a measure of how "rough" a surface is, in terms of how different the root means squared distance of any point on a surface is from a "perfect smoothness" mean plane for the surface, and skin depth is the depth at which electrical conduction takes place within conductor.

Finally, the characteristics of the transparent dielectric can be considered. For microstrip antennas such as the patch antenna, the permittivity $\varepsilon_r$ of the dielectric 48 in FIG. 4 can be inversely proportional to the bandwidth of the antenna. For high permittivity materials, the bandwidth of the resulting antenna can be narrow and the Q (quality factor) is high. For low permittivity materials, the bandwidth can be wide and the Q can be low. The height of the dielectric is also directly proportional to the bandwidth of the antenna. The relationship between the bandwidth of a resonating microstrip patch antenna and the dielectric substrate it resides on is shown below (Equation 2):

$$BW \propto \frac{\text{Height}}{\sqrt{\varepsilon_r}} \quad \text{Eq. (2)}$$

Where BW is the bandwidth of the microstrip antenna, height is the height of the dielectric substrate and $\varepsilon_r$ is the permittivity of the dielectric. The patch antenna is a resonant antenna, and therefore the operating frequency is directly proportional to the size and surface area of the antenna. By simply rastering the laser to change the shape, size, and surface area of the patch would drastically alter its performance and characteristics.

Figure 8:
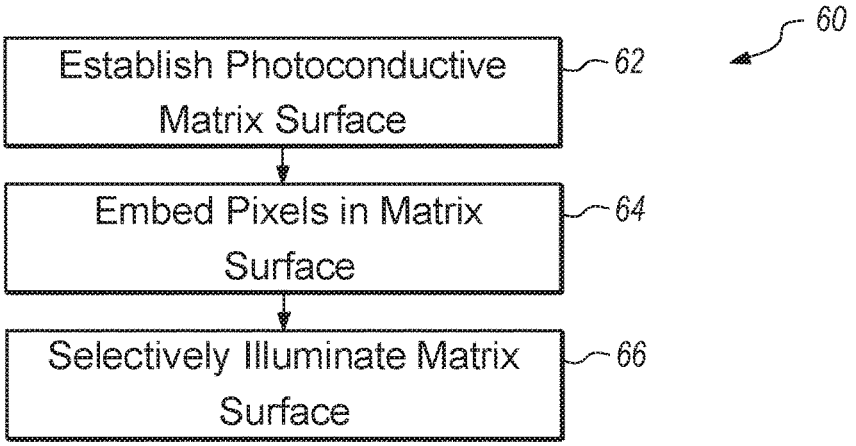

Referring now to FIG. 8, a block diagram 60 is provided to illustrate steps that can be taken to accomplish the methods of the present invention. As shown, the methods can include the initial step 62 of establishing a photoconductive matrix surface. The methods can further includes the step 64 or embedding pixels in the matrix so that the pixels are electrically isolated from the surface matrix, and selectively illuminated the matrix surface, as shown by 66. The structure and cooperation of surface for matrix surface, the pixels and the light source for selective illumination can be as described above.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An antenna comprising:

a photoconductive matrix surface;

a plurality of interdigitated, electrically isolated pixels embedded in said matrix surface; and, a light source for selectively illuminating said matrix surface to selectively activate said pixels.

2. The antenna of claim 1, further comprising:

a processor; and, said processor having non-transitory instructions for directing said light source in a predetermined pattern.

3. The antenna of claim 2, wherein said matrix surface is a two-dimensional surface.

4. The antenna of claim 2, wherein said matrix surface is a three-dimensional surface.

5. The antenna of claim 1, wherein each said pixel from said plurality has an edge length, and wherein said pixels are formed with a plurality of tines, said tines having a maximum edge length.

6. The antenna of claim 5, wherein adjacent pixels from said plurality define a gap, and further wherein said pixels are embedded in said surface matrix to minimize said gap.

7. The antenna of claim 5 wherein said pixels are diamond shaped when viewed in top plan.

8. The antenna of claim 5 wherein said pixels are square shaped when viewed in top plan.

9. The antenna of claim 2, wherein said pattern is selected from the group consisting of circular, conical, custom, bidirectional raster, unidirectional raster, bidirectional sector and unidirectional sector.

10. A method for propagating radiofrequency (RF) waves, comprising the steps of:

A) establishing a photoconductive matrix surface;

B) embedding a plurality of interdigitated, electrically isolated pixels in said matrix surface so that said plurality of interdigitated, electrically isolated pixels are electrically isolated; and, C) selectively illuminating said matrix surface with a light source.

11. The method of claim 10, wherein adjacent said interdigitated, electrically isolated pixels define a gap, and where said step B) is accomplished so that said gap is minimized.

12. The method of claim 10, wherein each of said pixels are formed with a plurality of tines, and wherein said tines have an edge length that is maximized, and there said step B) is accomplished so that said tines of adjacent said pixels are interdigitated.

13. The method of claim 10, wherein said step A) is accomplished to establish a two-dimensional surface.

14. The method of claim 10, wherein said step A) is accomplished to establish a three-dimensional surface.

15. The method of claim 13, wherein said step C) is accomplished in a predetermined pattern selected from the group consisting of circular, conical, custom, bidirectional raster, unidirectional raster, bidirectional sector and unidirectional sector.

16. The method of claim 11 wherein said pixels are diamond shaped when viewed in top plan.

17. The method of claim 10, wherein said pixels are square shaped when viewed in top plan.

18. A software defined antenna, comprising:

a light source;

a photoconductive surface;

a plurality of interdigitated, electrically isolated pixels embedded in said photoconductive surface;

a processor, said processor incorporating software to manipulate said light source to selectively illuminate said surface in a predetermined pattern; and, said pixels becoming electrically connected when said interdigitated, electrically isolated pixels are illuminated by said light source.

19. The antenna of claim 18, wherein said photoconductive surface is two-dimensional.

20. The antenna of claim 18, wherein said photoconductive surface is three-dimensional.

* * * * *